US006543379B2

(12) United States Patent
Schwartz

(10) Patent No.: US 6,543,379 B2
(45) **Date of Patent: *Apr. 8, 2003**

(54) CLASSIFICATION FILE FOLDER MARKER TABS

(75) Inventor: David C. Schwartz, Southboro, MA (US)

(73) Assignee: Productive Environments Inc, Framingham, MA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/450,619

(22) Filed: Nov. 30, 1999

(65) Prior Publication Data

US 2002/0134298 A1 Sep. 26, 2002

Related U.S. Application Data

(60) Provisional application No. 60/112,755, filed on Dec. 17, 1998.

(51) Int. Cl.[7] ..... B42F 21/00

(52) U.S. Cl. ..... 116/234; 116/239; 283/36; 283/37; 281/38

(58) Field of Search ..... 116/234, 238, 116/239; 283/36, 37, 38, 39, 40, 41, 42, 43; 281/38; 40/641; 402/79

(56) References Cited

U.S. PATENT DOCUMENTS

| | | | | | |
|---|---|---|---|---|---|
| 665,650 | A | * | 1/1901 | Clymer | 116/234 |
| 1,048,577 | A | * | 12/1912 | Pardoe, Jr. | 116/234 |
| 1,701,657 | A | * | 2/1929 | Asaturian | 281/38 |
| 4,134,437 | A | * | 1/1979 | Finn | 40/359 |
| 4,448,310 | A | * | 5/1984 | Hodgson | 116/234 |
| 4,932,683 | A | * | 6/1990 | Perazza | 283/36 |
| 5,456,497 | A | * | 10/1995 | Ross, Jr. | 116/234 |
| 5,515,809 | A | * | 5/1996 | Weinberg | 116/238 |
| 5,597,256 | A | * | 1/1997 | Burton et al. | 281/38 |
| 5,732,977 | A | * | 3/1998 | Kohana | 281/38 |
| 5,876,145 | A | * | 3/1999 | Datum | 283/37 |
| 5,947,525 | A | * | 9/1999 | Pollman | 283/36 |
| 5,967,561 | A | * | 10/1999 | Glenn | 283/36 |
| 6,109,205 | A | * | 8/2000 | Smith | 116/234 |
| 6,371,680 | B1 | * | 4/2002 | Webb | 283/36 |

FOREIGN PATENT DOCUMENTS

| | | | | |
|---|---|---|---|---|
| GB | 316823 | * | 8/1929 | 116/234 |
| JP | 0090393 A | * | 4/1991 | 116/234 |

* cited by examiner

*Primary Examiner*—Diego Gutierrez
*Assistant Examiner*—Madeline Gonzalez

(57) ABSTRACT

This invention relates to the separating of papers in a file folder and to a simple, minimalist formation of a multi-separator leaf which can be easily attached to a file folder or integrally formed with a file folder and whose multiple sections can be split apart and used to provide individual dividers for separate batches of paper. A single leaf comprising a leaf body and a leaf hinge portion is provided, where the leaf body is separable into a plurality of marker tab sections, —while remaining hingedly attached to the leaf hinge portion. The multi-separator leaf is provided as a separate entity where the leaf hinge portion can be attached at the spine of a file folder so as to become a part thereof. The multi-separator leaf can be attached at the spine of the file folder and provided as an integral part of a file folder. The primary use of the multi-separator leaf is to provide a selective means of separating one or more sheets of paper between successive marker tab sections of the multi-separator within the file folder.

9 Claims, 8 Drawing Sheets

CLASSIFICATION FILE FOLDER MARKER TABS

This application claims benefit of provisional application No. 60/112,755 filed Dec. 17, 1998.

BACKGROUND OF THE INVENTION

This invention relates to the separating of papers in a file folder and to a simple, minimalist formation of a multi-separator leaf which can be easily attached to a file folder or integrally formed with a file folder and whose multiple sections can be split apart and used to provide individual dividers for separate batches of paper. The invention provides for a single leaf comprising a leaf body and a leaf hinge portion, where the leaf body is separable into a plurality of marker tab sections, while remaining hingedly attached to the leaf hinge portion, and where the leaf hinge portion can be attached to or is integrally attached at the spine of a file folder so as to become a part thereof, for providing a selective means of separating one or more sheets of paper between successive marker tab sections.

The invention relates to a way of providing the lightest weight, thinnest multi-separator system for a file folder. Traditionally papers are put between the front and rear covers of a folder in a pile or batch. Recently, multi-pocket files having multiple segments have become popular, where the file is segmented into pockets. These files are essentially closed files having at least two closed sides. They do not operate as a folder. Sectioned classification files have existed where each section is a full panel and multiple full panels are used to separate the file. The panels may be integrally formed with the file or may be attached as an accessory. In any case, the partitioning of the file into multiple sections requires a full sized panel for each partition. The partitions may be dropped in, i.e. unattached, or may be attached at the hinge of the spine of the file folder. So classification file folders have been available with full card separators as classification tab markers.

This invention relates to classification tab markers formed as a portion of a full card divider. Full card dividers add cost and weight and bulk to a file folder. The advantage of this separable classification marker tab card is that one card can provide multiple indexes by separating each as needed. The separable classification marker tab card can be integrally glued into a file folder, or can be provided as an accessory that is added in. The adhesive can be permanent or removable. The separator perforations can extend to the hinged attachment flap or can go straight through the flap used to attach the marker card to the folder.

By hinging each separator tab together, the separators retain their position with respect to each other, adding stability to the file when full and allowing for the easy turning of a batch of separated papers without the dislodging of each marker tab section.

The invention therefore relates to the provision of a paperboard separator page having multiple sections, hingedly attached one to the next at a hinged end, and attachable as a leaf to a file folder at a file folder spine hinge. The invention relates to the formation of such a multi-section leaf with perforations to permit user separation of each section. The invention relates to the formation of such a multi-section leaf where each separable section is tinted or printed in a different color. The invention relates to the formation of such a multi-section leaf with an activatable adhesive strip on a hinged flap, where the adhesive may be activated by peeling a strip of release coated paper, for example, from the adhesive to expose the adhesive. The invention relates to the formation of such a multi-section leaf in plastic.

SUMMARY OF THE INVENTION

The object of the present invention is to provide a light weight, cost effective classification index marker card where the index strips can be readily separated as needed and where the card can be added to any file as needed. Further, the object is to provide a tab strip which can be separated from the marker leaf card at the hinge so that the tab section can be completely removed from the marker leaf for attachment to the batch of papers it was used to separate. The object of the invention is to provide for a set of marker tabs which can be separated in such a way as to be permanently retained at the hinge portion providing for a set of separator strips whose relative position one to the other is fixed. The object is to provide that in either case a classification index marker card can be attached to the hinged spine of a host file folder. In the case where the tabs are removable from the marker leaf card, the tabs may be easily attached by some means, as with staple, clip, or adhesive, to the batch of papers they are classifying. It is the object of the invention to provide for a very stable easily separable perforation, separating each marker tab of the multi-marker tab leaf, where the perforation is formed with at least two large cuts and a small land area between the cuts that can be easily "broken" apart by the user to form a free swinging marker tab section. It is the object of the invention to provide for a hinged flap with adhesive, where the adhesive is covered by a release coated strip which can be removed to expose and activate the adhesive for attaching the assembly to a host file folder.

BRIEF DESCRIPTION OF THE DRAWINGS

The above and other objects and advantages of the invention will be apparent from consideration of the following detailed description, taken to conjunction with the accompanying drawings, in which like reference characters refer to like parts throughout.

DETAILED DESCRIPTION OF THE INVENTION

Figure 1:
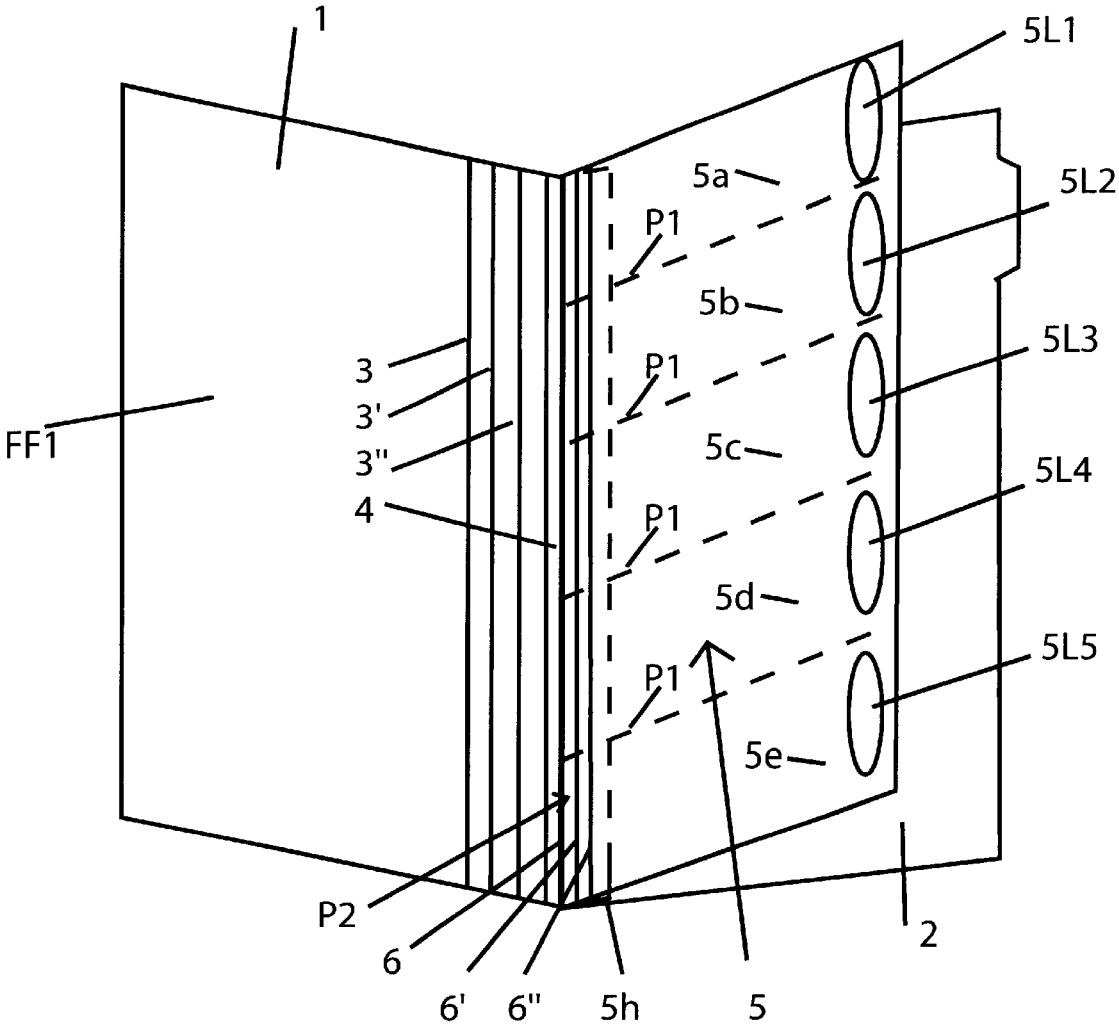
FIG. 1 Shows a perspective of a host file folder and a classification marker leaf with tabbed sections.
Figure 2:
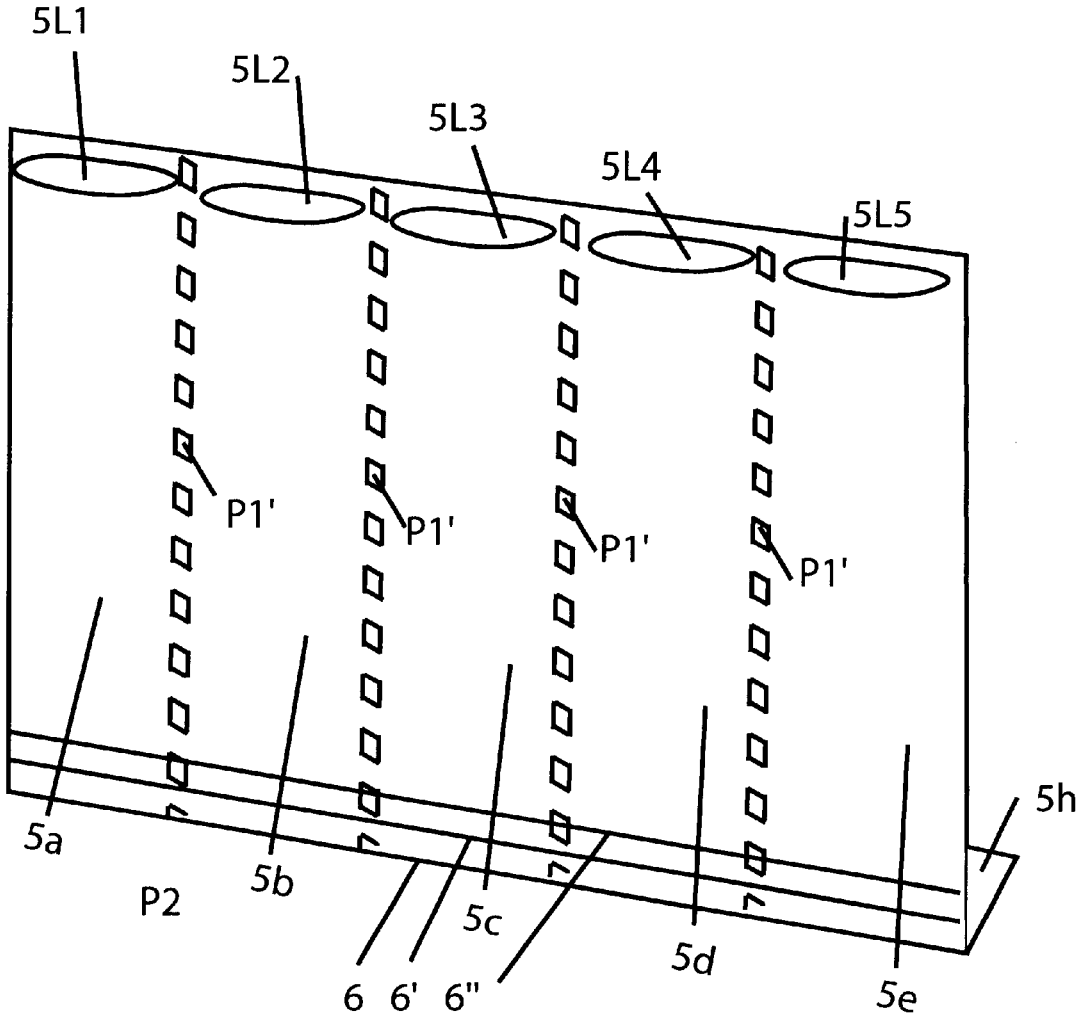
FIG. 2 Shows a classification marker leaf with tabbed sections, having an aggressive perforation separating each section FIG. 3 Shows a 6th cut tab leaf with a peelable adhesive strip on its hinged flap.
Figure 3:
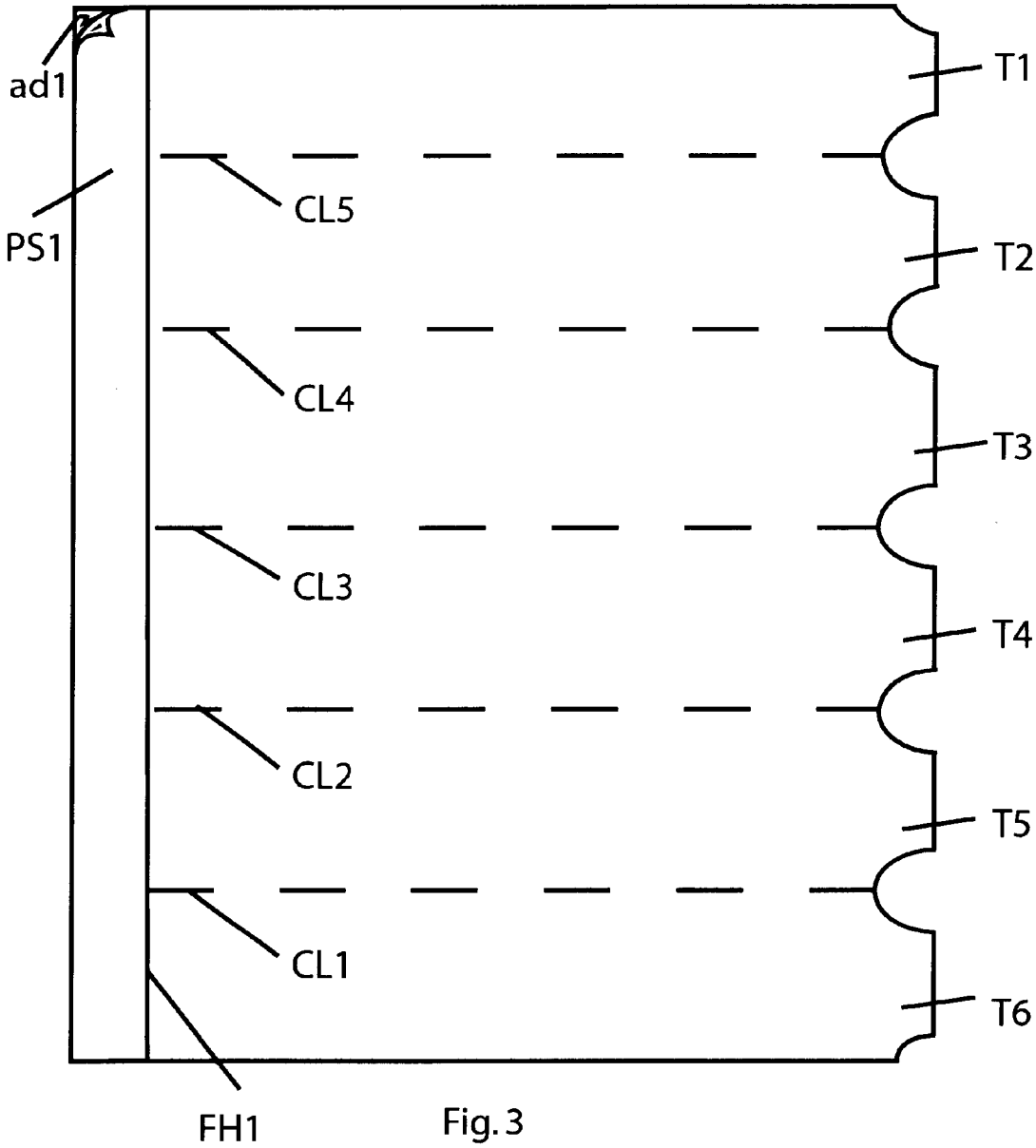
Figure 4:
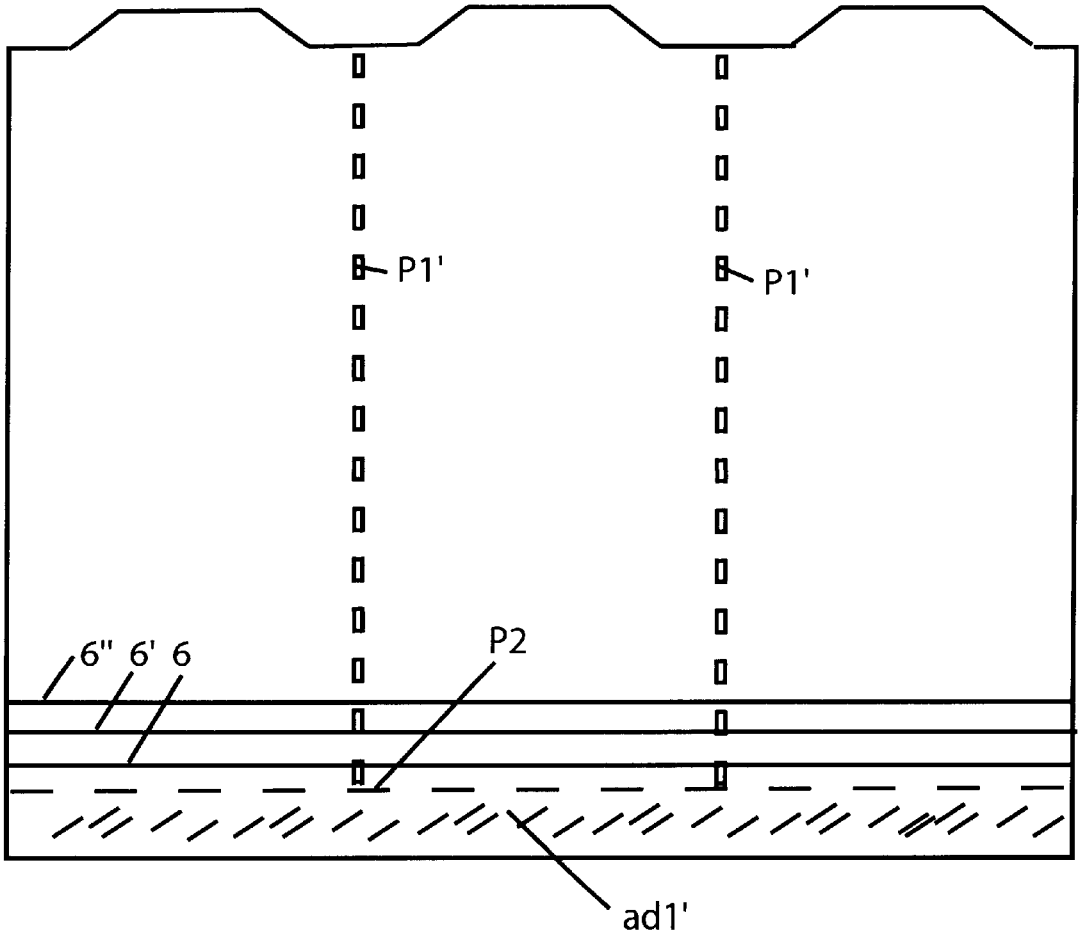
FIG. 4 Shows a third cut tab leaf with exposed adhesive
Figure 4A:
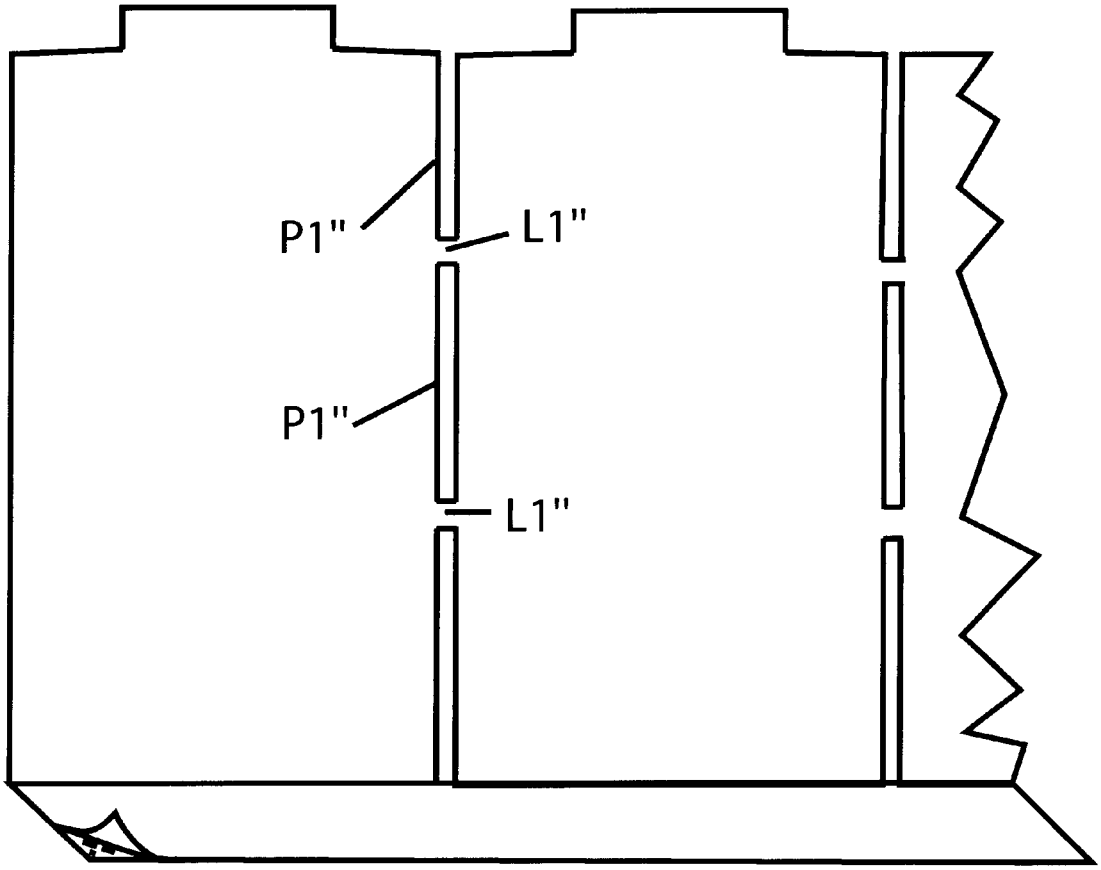
FIG. 4*a* Shows a preferred embodiment of a perforation for easily separating each tabbed section. The perforation stops at the hinged flap section.
Figure 5:
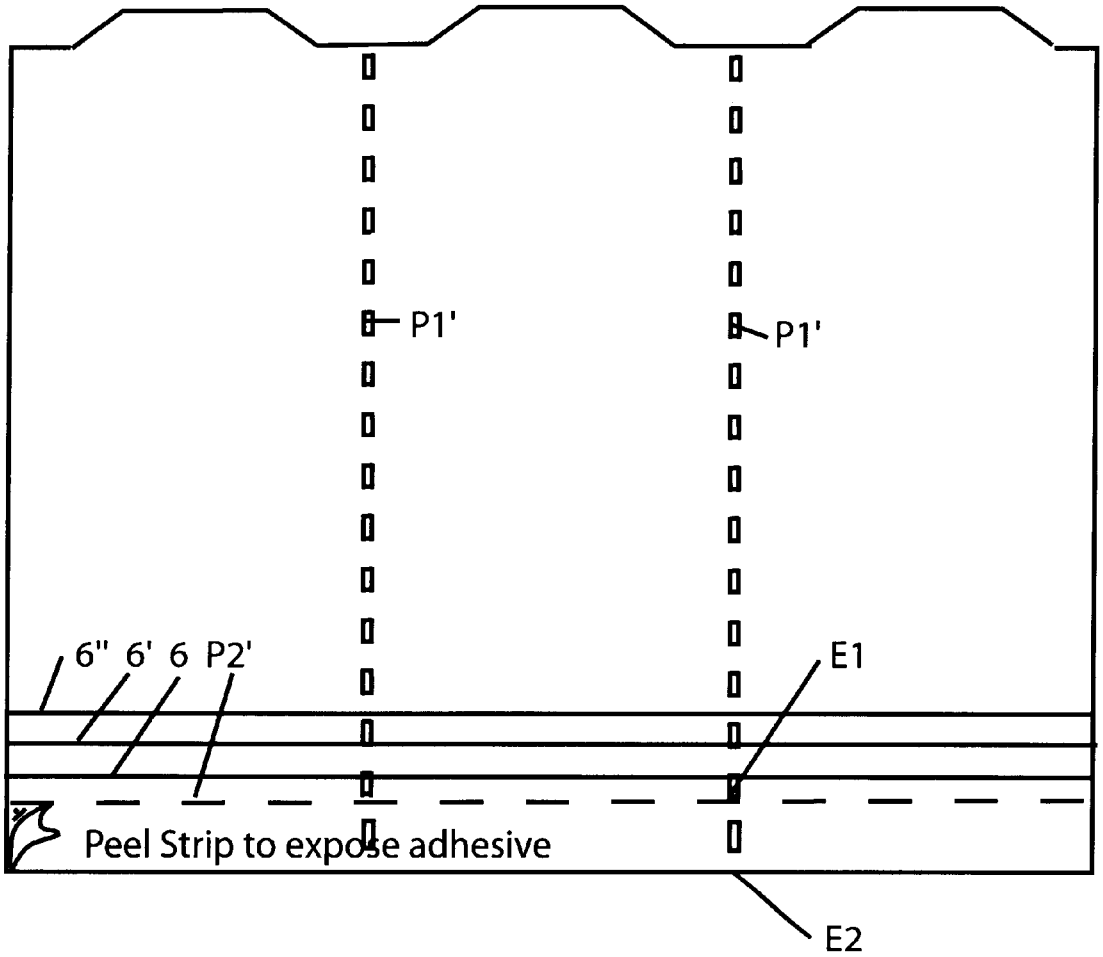
FIG. 5 Shows a third cut tabbed leaf with expansion area and marked peel strip. The perforations extend through the hinged flap section.

A preferred embodiment is shown in FIG. 1 where a file folder, FF1, comprising front, 1, and back cover, 2, has a marker card 5 attached permanently thereto, as an integral combination.

Each perforation, P1, can be separated to let each tab marker portion, 5*a*,5*b*,5*c*,5*d*,5*e*, swing separately about hinge p2. The flap, 5*h*, is the means for attaching the card 5, to the file folder FF1.

The hinge P2 is a fold perforation, sufficient to weaken the fibre of the card and permit easy folding. Of course, for a permanently attached marker tab set, the hinge P2 can be formed as a fold hinge without any perforation, such as by striking with a rule edge to preform the fold crease. Perforation P1 is a tear perforation and is easily separated. The preferred way to make this tear perforation for a paperboard card separator would naturally be to make a number of substantially large slit cuts, P1", connected by small "landed" areas, L1", as the means for separating each marker tab, one from the other. In this way,the card will retain some integral stability when first inserted, and each marker tab will easily separate one from the next, leaving clean edges along the tab length. The proposed embodiment is formed in paperboard.

Figure 6:
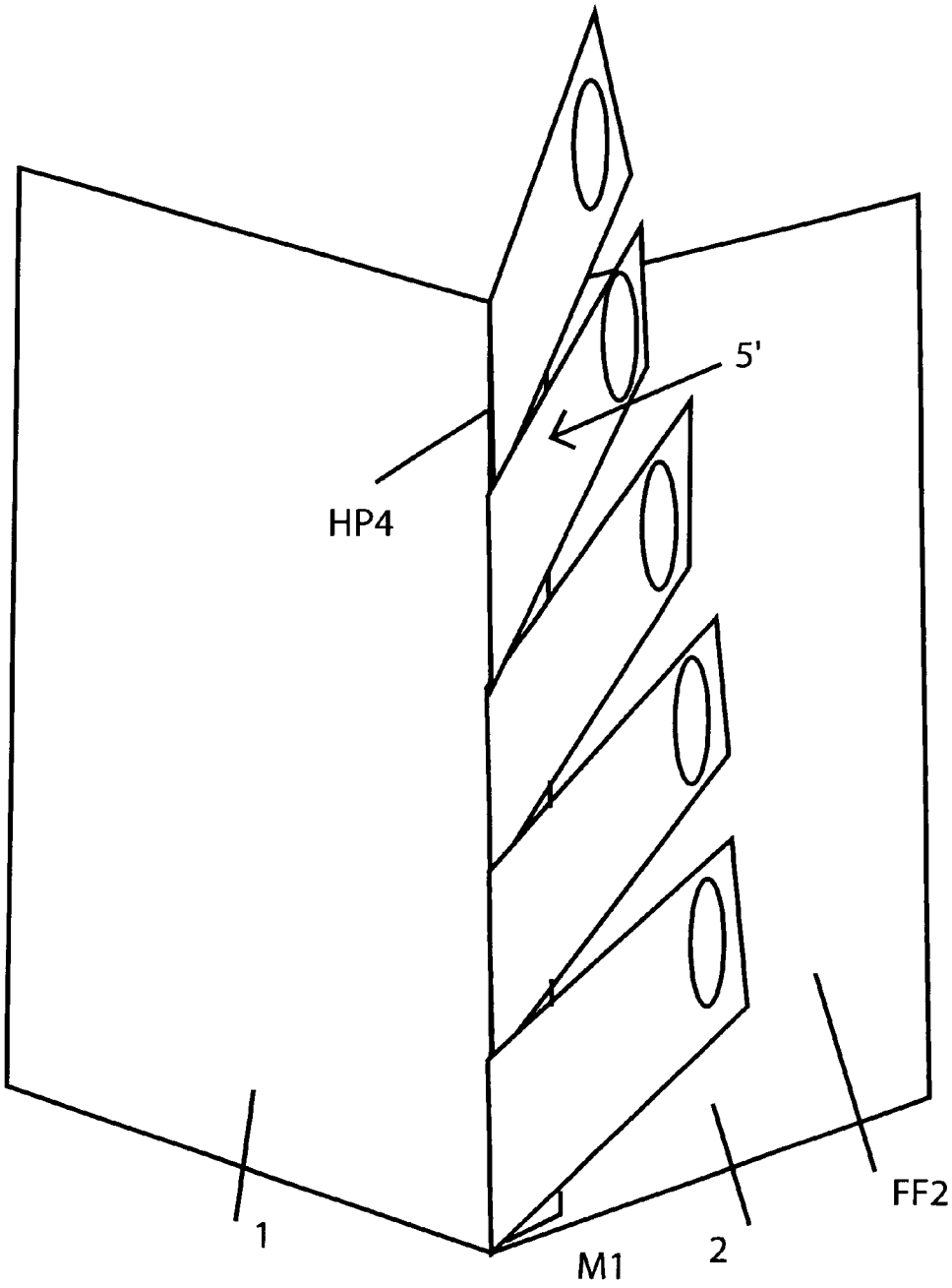
FIG. 6 Shows a poly plastic file folder and poly plastic classification separator where the classification leaf is integrally formed with the host file folder.
Figure 7:
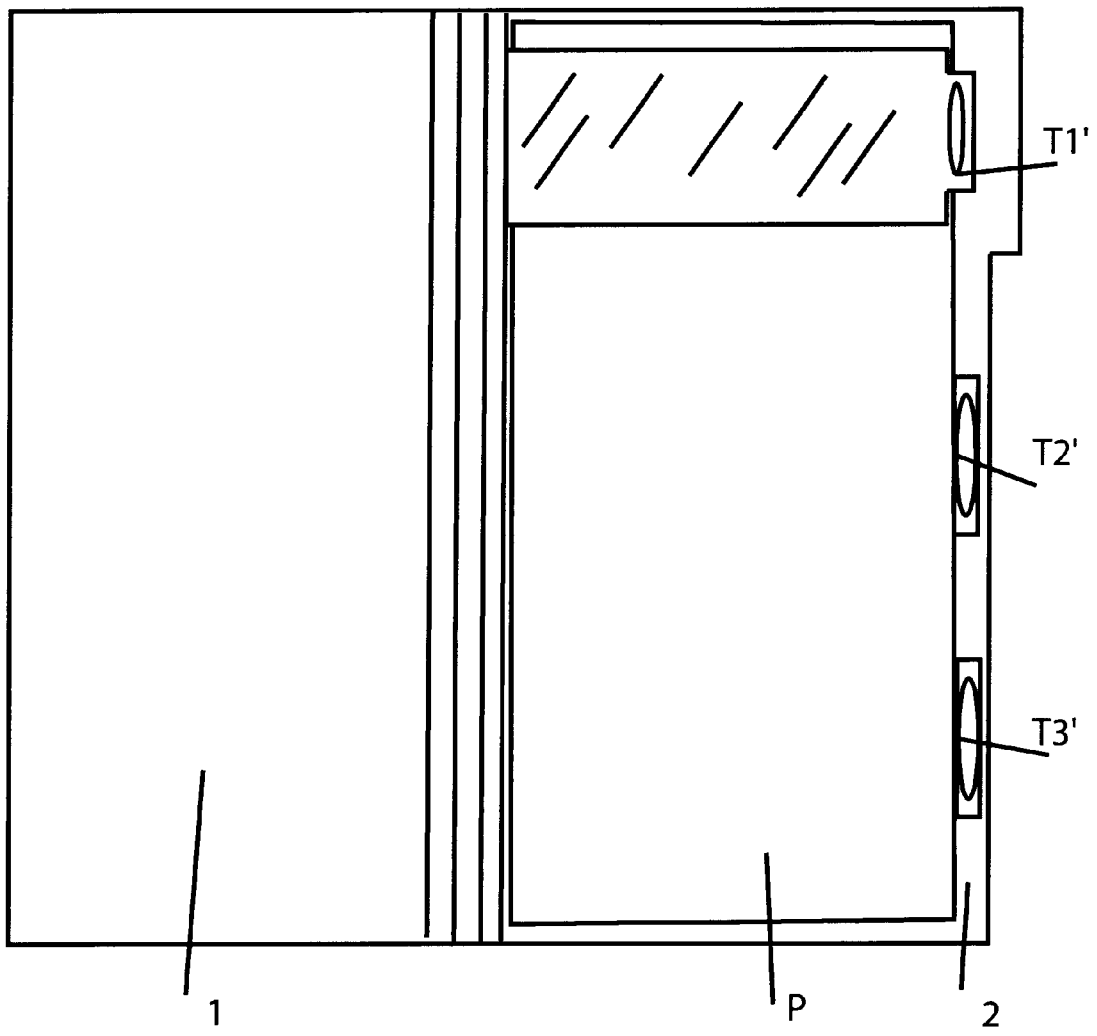
FIG. 7 Shows a perspective drawing of a "loaded" file showing how the tabbed separators segment the papers contained therein.

FIG. 6 shows an alternative material, plastic, in which a preseparted classification tab marker is "melted" by attachment means such as RF or heat at the hinge flap and spine. The material used can be poly plastic, in which case the means for attachment could still be an adhesive strip, peelable in the case of an accessory formulation. For directly attached embodiments where the file folder and the marker tab are the poly plastic, adhesive can be used or one of the traditional methods for sealing poly plastic such as RF or heat blade melting can be employed.

Any number of tab portions can be provided. The tab extent has an optional expansion portion 6, 6', 6" to permit capacity filling. The tabs will shorten slightly but if the original height of the tab is substantially to the top edge of the back of the file folder, the index label areas will remain visible even when the file is fully loaded.

A preferred embodiment as an accessory has a peal strip, PS1, which once removed exposes either a repositionable adhesive, ad1, or a permanent adhesive, ad1'.

The hinge can have printed indicia on it as can be the tab separator markers.

The tear perf P1' can extend through the attachment hinge or stop short of the attachment hinge. If it extends through, when used with a repositional adhesive, the tab markers can be separated and attached to a host leaf, like a repositional, note.

If paper board is used, a reasonably weighted paper is preferred to provide strength on lifting batches of papers when the separator sections are filled, and to differentiate it from plain paper. If plastic is used, the plastic can be pre-separated or can be perforated agressively or perforated using the large slits and small land segments, for user separation.

| Part# | Description |
|---|---|
| 1 | Front cover folder |
| 2 | Rear cover folder |
| 2' | Tab Index Folder |
| 3 | folder hinge for expansion |
| 3' | folder hinge for expansion |
| 3" | folder hinge for expansion |
| 4 | Folder spine |
| 5a | Classification marker tab |
| 5b | Classification marker tab |
| 5c | Classification marker tab |

-continued

| Part# | Description |
|---|---|
| 5d | Classification marker tab |
| 5e | Classification marker tab |
| P1 | tear perforation type 1 |
| P2 | hinge perforation type 2 |
| 5L1 | Classification marker tab label area |
| 5L2 | Classification marker tab label area |
| 5L3 | Classification marker tab label area |
| 5L4 | Classification marker tab label area |
| 5L5 | Classification marker tab label area |
| 6 | Classification marker spine |
| 6' | classification marker expansion score |
| 6" | Classification marker expansion score |
| 5h | Classification marker hinged flap |
| P1' | Tear perforation type 3-small |
| P1" | Tear perforation type 4-large |
| L1" | Small land area |
| CL1 | Cut line 1 indication for cutting tab separation |
| CL2 | Cut line 2 indication for cutting tab separation |
| CL3 | Cut line 3 indication for cutting tab separation |
| CL4 | Cut line 4 indication for cutting tab separation |
| CL5 | Cut line 5 indication for cutting tab separation |
| ad1 | adhesive type 1-removable/repositional |
| ad1' | adhesive type 2-permanent |
| T1 | tab 1 |
| T2 | tab 2 |
| T3 | tab 3 |
| T4 | tab 4 |
| T5 | tab 5 |
| T6 | tab 6 |
| P2" | hinge perforation type 3-foldable |
| E1 | End of hinge perforation portion for tearing clear off |
| E2 | End of hinge perforation portion for tearing clear off |
| T1' | Tab 1' |
| T2' | Tab 2' |
| T3' | Tab 3' |
| HP4 | Hinge perforation type 4-tearable at spine of hinge flap |
| 5' | Plastic classification tab |
| FF2 | Plastic file folder |
| M1 | melt 1 for attaching plastic |

One skilled in the art will appreciate that the present invention can be practiced by other than the embodiments described, which are presented for the purpose of illustration and not of limitation, and the present invention is limited only by the claims which follow:

What is claimed is:

1. A classification file folder marker tab, for use with a file folder having a front cover, a back cover, and a file folder spine connecting said front and said back cover, said classification file folder marker tab consisting of a multi-separator leaf for sectioning papers in a file folder, said multi-separator leaf formed as a single leaf member from a thin, foldable, and flexible material, said single leaf member consisting of a leaf body portion and a leaf hinge portion, said leaf hinge portion being permanently and hingedly attached to said leaf body portion along a classification marker spine, said leaf hinge portion for connection to a file folder at said file folder spine, wherein said leaf body portion is further comprised of a plurality of separable marker tab sections sharing an adjacent edge one with the next, where said each of said separable marker tab sections is joined one to the next by a perforation, wherein said perforation originates at said classification marker spine and comprises at least one slit and least one landed area along the full extent of said each adjacent edge of said separable marker tab sections, for retaining said each of said marker tab sections one to another until separated, such that when each of said marker tab sections is separated one from the next by tearing along said perforation, said each of said marker tab sections may be rotated forward and back while remaining hingedly attached to said leaf hinge portion, said marker tab sections for forming a plurality of tab separators for separating papers in a file folder.

2. The classification file folder marker tab of claim 1 where in said leaf hinge portion has a pressure sensitive adhesive applied on a face there of.

3. The classification file folder marker tab of claim 1 where in said thin, foldable, flexible material is paperboard.

4. The classification file folder marker tab of claim 1 where in said thin, foldable, flexible material is poly plastic.

5. A classification file folder marker tab, for use with a file folder having a front cover, a back cover, and a file folder spine connecting said front and said back cover, said classification file folder marker tab consisting of a multi-separator leaf for sectioning papers in a file folder, said multi-separator leaf formed as a single leaf member from a thin, foldable, and flexible material, said single leaf member consisting of a leaf body portion and a leaf hinge portion, said leaf hinge portion being permanently and hingedly joined to said leaf body portion along a classification marker spine, said leaf hinge portion for connection to a file folder at said file folder spine, wherein said leaf body portion is further comprised of a plurality of adjacent and separated marker tab sections sharing an adjacent edge one with the next, each separated one from the next by a separation cut, wherein said separation cut originates at said classification marker spine and comprises a cut along the full extent of said each adjacent edge of said separable marker tab sections, where in said each of said marker tab sections is free to hinge forward or backward one from the next forming a plurality of tab separators for separating papers, such that when separated, said each of said marker tab sections remains hingedly attached to said leaf hinge portion.

6. The classification file folder marker tab of claim 5 where in said leaf hinge portion has a pressure sensitive adhesive applied on a face there of.

7. The classification file folder marker tab of claim 5 where in said thin, foldable, flexible material is paperboard.

8. The classification file folder marker tab of claim 5 where in said thin, foldable, flexible material is poly plastic.

9. In combination, a classification file folder marker tab attachment, for use with a file folder, and a file folder having a front cover, a back cover, and a file folder spine connecting said front and said back cover, said classification file folder marker tab attachment selected from the group consisting of:

(a) a classification file folder marker tab consisting of a multi-separator leaf for sectioning papers in a file folder, said multi-separator leaf formed as a single leaf member from a thin, foldable, and flexible material, said single leaf member consisting of a leaf body portion and a leaf hinge portion, said leaf hinge portion being hingedly attached to said leaf body portion along a classification marker spine, said leaf hinge portion for connection to a file folder at said file folder spine, wherein said leaf body portion is further comprised of a plurality of separable marker tab sections, where said each of said separable marker tab sections is adjacent one to the next along an adjacent edge where said adjacent edge originates at said classification marker spine and ends at the top edge above the label area of each marker tab section, and where each marker tab section is completely separable along said, adjacent edge, and (b) classification file folder marker tab consisting of a multi-separator leaf for sectioning papers in a file folder, said multi-separator leaf formed as a single leaf member from a thin, foldable, and flexible material, said single leaf member consisting of a leaf body portion and a leaf hinge portion, said leaf hinge portion being permanently and hingedly attached to said leaf body portion along a classification marker spine, said leaf hinge portion for connection to a file folder at said file folder spine, wherein said leaf body portion is further comprised of a plurality of separable marker tab sections sharing an adjacent edge one with the next, where said each of said separable marker tab sections is joined one to the next by a perforation, wherein said perforation originates at said classification marker spine and comprises at least one slit and at least one landed area along the full extent of said each adjacent edge of said separable marker tab sections, wherein said classification file folder marker tab leaf hinge portion is permanently attached to said file folder with said classification marker spine being aligned and substantially collinear with said file folder spine, such that said each of said marker tab sections is free to hinge forward or backward one from the next while said each of said marker tab sections remains hingedly attached to said leaf hinge portion, thereby forming a plurality of tab separators for separating papers.

* * * * *